US011810698B2

(12) United States Patent
Celik

(10) Patent No.: US 11,810,698 B2
(45) Date of Patent: Nov. 7, 2023

(54) MAGNET

(71) Applicant: Dyson Technology Limited, Wiltshire (GB)

(72) Inventor: Tuncay Celik, Swindon (GB)

(73) Assignee: Dyson Technology Limited, Malmesbury (GB)

( * ) Notice: Subject to any disclaimer, the term of this patent is extended or adjusted under 35 U.S.C. 154(b) by 595 days.

(21) Appl. No.: 15/742,460

(22) PCT Filed: Jun. 29, 2016

(86) PCT No.: PCT/GB2016/051945
§ 371 (c)(1),
(2) Date: Jan. 5, 2018

(87) PCT Pub. No.: WO2017/006083
PCT Pub. Date: Jan. 12, 2017

(65) Prior Publication Data

US 2018/0197665 A1 Jul. 12, 2018

(30) Foreign Application Priority Data

Jul. 6, 2015 (GB) ..... 1511822

(51) Int. Cl.
*H01F 1/057* (2006.01)
*H01F 41/02* (2006.01)

(52) U.S. Cl.
CPC ..... *H01F 1/0577* (2013.01); *H01F 41/0293* (2013.01)

(58) Field of Classification Search
CPC . H01F 1/0577; H01F 41/0293; H02K 1/2766; H02K 1/278
See application file for complete search history.

(56) References Cited

U.S. PATENT DOCUMENTS 4,368,011 A * 1/1983 Woodling ..... F01C 1/113 418/61.3
5,229,738 A * 7/1993 Knapen ..... H01F 41/028 310/156.43

(Continued)

FOREIGN PATENT DOCUMENTS

CN 101641854 2/2010
CN 101939804 1/2011

(Continued)

OTHER PUBLICATIONS

King et al. ("Rare earth/metal composite formation by cold spray." Journal of thermal spray technology 17.2 (2008): 221-227.) (Year: 2008).*

(Continued)

*Primary Examiner* — Ricardo D Morales
(74) *Attorney, Agent, or Firm* — Faegre Drinker Biddle & Reath LLP

(57) ABSTRACT

Magnets and systems, methods, and techniques for manufacturing magnets are provided. In some embodiments, methods of manufacturing magnets comprise providing a rare earth magnetic body, depositing a bead of dysprosium or terbium metal onto a part of the magnetic body to form a magnet; and heat-treating the magnet. In some embodiments, a magnet is provided comprising a magnetic body and a bead of dysprosium or terbium metal. In some embodiments, the magnetic body contains grains of rare earth magnet alloy, and the bead of dysprosium or terbium metal is deposited onto a part only of a surface of the magnetic body.

23 Claims, 3 Drawing Sheets

(56) References Cited

U.S. PATENT DOCUMENTS

| | | | | |
|---|---|---|---|---|
| 5,302,414 | A * | 4/1994 | Alkhimov | B05B 7/144 427/191 |
| 6,465,039 | B1 | 10/2002 | Pinkerton et al. | |
| 8,002,906 | B2 | 8/2011 | Suzuki et al. | |
| 8,420,160 | B2 | 4/2013 | Sagawa | |
| 8,421,292 | B2 * | 4/2013 | Natsumeda | H01F 41/0293 310/156.43 |
| 8,480,815 | B2 | 7/2013 | Wang | |
| 2002/0182311 | A1 | 12/2002 | Leonardi et al. | |
| 2004/0202797 | A1 | 10/2004 | Ginder et al. | |
| 2005/0208218 | A1 | 9/2005 | Becker et al. | |
| 2007/0034299 | A1 | 2/2007 | Machida et al. | |
| 2009/0321210 | A1 | 12/2009 | Tung et al. | |
| 2010/0007232 | A1 | 1/2010 | Komuro et al. | |
| 2010/0109468 | A1 | 5/2010 | Natsumeda et al. | |
| 2011/0167929 | A1 | 7/2011 | Ling et al. | |
| 2011/0210810 | A1 | 9/2011 | Miyata et al. | |
| 2011/0250087 | A1 | 10/2011 | Sagawa | |
| 2011/0289765 | A1 | 12/2011 | Bohn et al. | |
| 2012/0139388 | A1 | 6/2012 | Iwasaki et al. | |
| 2013/0000447 | A1 | 1/2013 | Hosek et al. | |
| 2013/0092867 | A1 | 4/2013 | Shoji et al. | |
| 2013/0196145 | A1 | 8/2013 | Buresh et al. | |
| 2013/0248744 | A1 | 9/2013 | Graner et al. | |
| 2014/0117978 | A1 | 5/2014 | Hund et al. | |
| 2014/0167895 | A1 | 6/2014 | Miyata et al. | |
| 2014/0312523 | A1 | 10/2014 | Kawashita et al. | |
| 2015/0187494 | A1 | 7/2015 | Lee et al. | |
| 2018/0204677 | A1 | 7/2018 | Celik | |

FOREIGN PATENT DOCUMENTS

| | | |
|---|---|---|
| CN | 104067357 | 9/2014 |
| DE | 10 2005 056 823 | 5/2007 |
| DE | 10 2006 021 260 | 11/2007 |
| EP | 1 643 513 | 4/2006 |
| EP | 1 705 669 | 9/2006 |
| EP | 1 830 371 | 9/2007 |
| EP | 2 131 474 | 12/2009 |
| EP | 2 254 131 | 11/2010 |
| EP | 2790193 | 10/2014 |
| EP | 2 808 877 | 12/2014 |
| FR | 2 963 428 | 2/2012 |
| GB | 2497573 | 6/2013 |
| GB | 2515019 | 12/2014 |
| JP | S57-155375 | 9/1982 |
| JP | 2004-91902 | 3/2004 |
| JP | 2005-142374 | 6/2005 |
| JP | 2005-191281 | 7/2005 |
| JP | 2007-12999 | 1/2007 |
| JP | 2007-258455 | 10/2007 |
| JP | 2008-71904 | 3/2008 |
| JP | 2009-212466 | 9/2009 |
| JP | 2010-22147 | 1/2010 |
| JP | 2010-119190 | 5/2010 |
| JP | 2010-129665 | 6/2010 |
| JP | 2011-35001 | 2/2011 |
| JP | 2012-236354 | 12/2012 |
| JP | 2013-42152 | 2/2013 |
| JP | 2013-161829 | 8/2013 |
| JP | 5310544 | 10/2013 |
| KR | 10-0208221 | 7/1999 |
| KR | 10-2011-0096104 | 8/2011 |
| KR | 10-1447301 | 10/2014 |
| RU | 2 353 706 | 4/2009 |
| WO | WO-2004/078010 | 9/2004 |
| WO | WO-2011/036004 | 3/2011 |
| WO | WO-2011/039001 | 4/2011 |
| WO | WO-2011/039003 | 4/2011 |
| WO | 2011/108704 | 9/2011 |
| WO | WO-2013/176096 | 11/2013 |

OTHER PUBLICATIONS

Search Report dated Jan. 6, 2016, directed to GB Application No. 1511822.7; 1 page.

International Search Report and Written Opinion dated Sep. 22, 2016, directed to International Application No. PCT/GB2016/051945; 11 pages.

Examination Report dated Jun. 14, 2019, directed to EP Application No. 16736568.3; 2 pages.

Examination Report dated Sep. 24, 2018, directed to GB Application No. 1511822.7; 3 pages.

First Office Action dated Apr. 28, 2019, directed to CN Application No. 201680040348.0; 22 pages.

King, Peter C., et al. (Jun. 2007). "Rare Earth/Metal Composite Formation by Cold Spray," Journal of Thermal Spray Technology 17(2):221-227.

Notice of Reasons for Rejection dated Oct. 1, 2018, directed to JP Application No. 2018-500419; 8 pages.

Notification of Reason for Refusal dated May 13, 2019, directed to KR Application No. 10-2018-7003041; 18 pages.

Celik, Office Action dated Apr. 22, 2020, directed to U.S. Appl. No. 15/742,456; 10 pages.

Celik, Office Action dated Dec. 16, 2020, directed to U.S. Appl. No. 15/742,456; 12 pages.

Celik, Office Action dated Jul. 31, 2020, directed to U.S. Appl. No. 15/742,456; 11 pages.

Examination Report dated Jun. 14, 2019, directed to EP Application No. 16736567.5; 2 pages.

Examination Report dated Sep. 24, 2018, directed to GB Application No. 1511821.9; 3 pages.

First Office Action dated Apr. 17, 2019, directed to CN Application No. 201680040262.8; 16 pages.

Notice of Reasons for Rejection dated Oct. 5, 2018, directed to JP Application No. 2018-500433; 9 pages.

Notification of Reason for Refusal dated May 13, 2019, directed to KR Application No. 10-2018-7003040; 16 pages.

Search Report dated Jan. 6, 2016, directed to GB Application No. 1511821.9; 2 pages.

* cited by examiner

MAGNET

REFERENCE TO RELATED APPLICATIONS

This application is a national stage application under 35 USC 371 of International Application No. PCT/GB2016/051945, filed Jun. 29, 2016, which claims the priority of United Kingdom Application No. 1511822.7, filed Jul. 6, 2015, the entire contents of which are incorporated herein by reference.

FIELD OF THE INVENTION

The present invention relates to rare earth magnets and methods of making rare earth magnets. More specifically, the present invention relates to rare earth magnets with improved coercivity and methods of making the same.

BACKGROUND OF THE INVENTION

Rare earth magnets may comprise a crystal lattice structure containing grains of rare earth alloys. It has been shown that the magnetic properties, particularly the coercivity, of such magnets can be improved by substituting rare earth magnetic elements such as dysprosium or terbium into the crystal lattice structure. Dysprosium or terbium can be substituted either into the bulk of the crystal lattice, for instance via a binary addition, or along the grain boundaries of the crystal lattice via a heat-treatment step, such as grain boundary diffusion. Diffusion of dysprosium or terbium along the grain boundaries is preferred as less dysprosium or terbium is required to achieve the same improvements in magnetic properties, such as coercivity.

For grain boundary diffusion, dysprosium or terbium must be deposited on the rare earth magnet for effective substitution to occur. The high price and low natural abundance of dysprosium and terbium however has meant that recent research efforts have focused on providing an improved magnet using smaller amounts of dysprosium or terbium. A problem with these deposition techniques is that a considerable amount of time may be required to deposit the dysprosium or terbium, and that wastage of expensive dysprosium or terbium can still occur. It is also considered that some dysprosium containing materials used in current deposition techniques, for example $DyF_3$, may be detrimental to the magnetic properties of the substrate. A method of depositing dysprosium or terbium onto a rare earth magnetic substrate that is fast and/or materially efficient without having a detrimental effect on the magnetic properties of the substrate is desired.

SUMMARY OF THE INVENTION

In a first aspect, a magnet comprises a magnetic body and one or more beads of dysprosium metal; wherein the magnetic body contains grains of rare earth magnet alloy, and each bead is deposited onto a part only of a surface of the magnetic body.

During use, a magnet can be permanently demagnetised (lose some or all of its magnetic strength) due to temperature increases and/or reverse field effects. These effects do not occur uniformly within the magnet, the location of the sites of demagnetisation often depends on the application of the magnet, i.e. in a motor or generator. As a result, ideally, the coercivity of a magnet is graded in order to counteract these effects. By depositing a bead of dysprosium metal onto a particular part only of a surface of a magnetic body, the grading of coercivity across the magnetic substrate can be more carefully controlled. The term bead is intended to define an amount of metal that could be formed in a variety of shapes and sizes and deposited onto a specific site on the surface of the rare earth magnet.

The deposition of the bead of dysprosium metal can be achieved using various deposition techniques. By depositing only a bead of dysprosium onto the magnetic body, less material is required and the same improvements in coercivity etc are achieved on or around the targeted site of the magnet. The targeted site of the magnet can be the part of the magnet that experiences high levels of temperature fluctuations or reverse field effects during use. The improvement in magnetic properties may not be required for the entire magnetic body and so wastage of expensive dysprosium is avoided.

The grains of rare earth alloy may include magnetic alloys that contain samarium, praseodymium, cerium or neodymium. Of specific interest are sintered alloys containing neodymium or samarium alloys, particularly $Nd_2Fe_{14}B$, $SmCo_5$ and $Sm(Co, Fe, Cu, Zr)_7$.

Each bead may be deposited onto a respective pole of the magnetic body. The magnet comprises at least two poles and so a bead of dysprosium can be deposited onto each pole to enhance the magnetic properties of each pole.

The poles of a magnet are arranged such that they can be divided geometrically by lines that pass in-between the changing polarity of the field of the poles. The magnetic density of each pole is greatest in the region that is furthest away from its corresponding intersectional pole boundaries. The surface of the magnet body may be therefore geometrically divided by pole intersections, and each bead may then be deposited in a respective region that is spaced away from the pole intersections i.e. each bead does not overlie a pole intersection. The deposition of a bead of dysprosium in this region leads to a magnet with improved coercivity and magnetic properties. In addition, a small amount of dysprosium deposited in this region provides an efficient and cost effective way of improving the magnetic properties of a magnet without having to deposit dysprosium across the whole surface of the magnetic body. Additionally, the bead may be deposited at the edge of the magnet body surface. By depositing the bead in a respective region that is spaced away from the pole intersections and also along an edge of the magnet, the dysprosium is deposited in the region with the highest magnet field density.

The magnet may be cylindrical in shape. Cylindrical magnet shapes include annular and ring magnets, as well as solid cylinder disc magnets. A cylindrical shape allows for the use of the magnet in motor and generator applications. More generally, a number of non-cylindrical magnets can be put together to form a magnetic assembly that may be cylindrical in shape.

The magnetic body may be sintered. A sintered magnetic body allows for better grain boundary diffusion to occur. It is appreciated that a degree of sintering can take place during the grain boundary diffusion heat-treatment. However it is more beneficial if the magnetic body has been pre-sintered prior to the cold spray deposition of the dysprosium bead. A pre-sintered magnetic body means that a separate heat-treatment step is required for diffusing the dysprosium into the body. This separate heat-treatment step can be carefully tuned so that a grain boundary diffusion is dominant over a full diffusion into the alloy grains.

Each metal bead may be deposited via a cold spray process. The use of cold spray to deposit a bead of dysprosium onto the magnetic body has several advantages over conventional techniques. For example, dysprosium metal can be used directly in the process instead of dysprosium rich powders, such as $DyF_3$ or $Dy_2O_3$. As mentioned above, fluoride slurries may be detrimental to the magnetic properties of the magnetic substrate. Where a powder rich in $Dy_2O_3$ is used, dysprosium oxide can remain after heat-treatment or further sintering of the magnet leading to inefficient substitution of dysprosium into the lattice structure. These undesired side-effects may be overcome by cold spraying dysprosium metal instead of dysprosium oxides directly onto the magnetic body.

Conventional deposition techniques, such as dysprosium vapour-sorption and dip coating, require a large amount of time and controlled conditions to produce a rare earth magnet with sufficient levels of dysprosium substitution. In contrast, with a cold spray process a less controlled environment is possible and the deposition process is relatively rapid, with dysprosium deposition taking a matter of seconds. Additionally, since standard conditions may be used in cold spray, less of the dysprosium metal is oxidised during processing, thereby providing a better quality of dysprosium for diffusion within the magnetic body.

The amount of dysprosium deposited on the magnetic body can also be carefully controlled and specifically targeted using a cold spraying process. Conventional deposition techniques can lead to unpredictable amounts of deposition and also a high wastage of expensive dysprosium metal that is deposited in the areas where the requirement of high coercivity, and hence dysprosium, is less critical.

Due to the nozzle used to cold spray dysprosium, targeted deposition onto a magnetic body is easier and quicker to perform compared to the surface masking techniques required for other dysprosium coating methods such as sputter coating and chemical vapour deposition. Targeted coating with techniques such as sputter coating and Chemical Vapor Deposition (CVD), where the surface of the magnet is masked to achieve a targeted coating and hence controlled coercivity distribution do not result in a reduction of the amount of dysprosium used in the process.

During heat treatment an amount of dysprosium may be diffused within the grains. A smaller amount of diffused dysprosium can improve the coercivity of the magnetic body compared with increasing the initial amount of dysprosium in the grains. Furthermore, the amount of diffusion can be controlled and tuned by varying the conditions of heat treatment, i.e. temperature ramp up, holding time and temperature, cooling rates and gas atmosphere. The grains may contain an amount of diffused dysprosium of between 0.5 to 15 percent by weight and the dysprosium can be diffused along the boundaries of the grains to form a shell layer.

The grains may comprise a neodymium alloy. Neodymium alloys have a favourable magnetic strength and are widely used in applications where a magnetically strong permanent magnet is required. Examples of such applications include electric motors and generators. For some applications the operating temperature can exceed 150° C.

The coercivity of conventional neodymium magnets however can suffer at elevated temperatures. It has been found that substituting an amount (typically as much as 12%) of neodymium for dysprosium in the crystal lattice can significantly increase coercivity and improve the performance of the magnet at elevated temperatures.

When depositing dysprosium onto a neodymium magnetic surface, the diffused dysprosium magnetically couples anti-parallel to the neodymium which in turn reduces the overall magnetic field strength of the magnet. However, by controlling and limiting the amount of dysprosium that is deposited onto the surface, the overall impact on the remanence of the magnet will be less than a full uniform coating of dysprosium. The neodymium alloy may be $Nd_2Fe_{14}B$ which exhibits a particularly improved magnet. It is believed that the improvement in coercivity is due to $Dy_2Fe_{14}B$ and $(Dy,Nd)_2Fe_{14}B$ having a higher anisotropy field than $Nd_2Fe_{14}B$.

The $Nd_2Fe_{14}B$ alloy magnet may comprise grains of $Nd_2Fe_{14}B$ with a shell layer comprising $Dy_2Fe_{14}B$ or $(Dy,Nd)_2Fe_{14}B$, the shell layer having a thickness of about 0.5 μm. The deposited dysprosium diffuses through the magnetic body during a heat-treatment after depositing the cold sprayed bead of dysprosium on the magnetic body. During the heat-treatment, the deposited dysprosium substitutes with neodymium atoms along the grain boundaries of the crystal lattice, instead of permeating throughout the bulk of the crystal lattice. The shell layer of the grains produced by cold spray and heat-treatment can be controlled and hence much thinner compared to magnets produced by other methods. The shell layer can have a thickness of 0.5 μm. Therefore a much higher concentration of dysprosium is present at the grain boundaries, meaning that less dysprosium is needed to achieve the same coercivity enhancement that is exhibited in conventional dysprosium substituted rare earth magnets.

The deposition thickness of the bead of dysprosium may be between 1 to 5 μm. This thickness results in effective grain boundary diffusion during heat treatment and also reduces wastage of expensive dysprosium. The bead of dysprosium should have an average deposition thickness of 1 to 5 μm since a bead with a uniform deposition thickness is not required.

In a second aspect, the present invention provides a method of manufacturing a magnet, the method comprising: providing a magnetic body containing grains of a rare earth alloy; depositing a bead of dysprosium metal onto a surface of the magnetic body to form a magnet; and heat-treating the magnet.

Heat-treating the magnet may comprise a grain boundary diffusion process. More specifically, heat-treating the magnet may comprise: heating the magnet to a first elevated temperature; cooling the magnet to second elevated temperature; and quenching the magnet to room temperature. This process can be conducted such that the first elevated temperature may be at least 900° C. Independent of the first temperature, the second elevated temperature may be at least 500° C. In addition to the temperatures, the magnet may be held at the first elevated temperature for at least 6 hours. Independent of the time that the magnet is held first temperature, the magnet may be held at the second elevated temperature for at least 0.5 hours. These temperatures and times are particularly favoured as they provide good diffusion conditions without the grains undergoing sintering or further sintering.

In a third aspect, a magnet comprises a magnetic body and one or more beads of terbium metal; wherein the magnetic body contains grains of rare earth magnet alloy, and each bead is deposited onto a part only of a surface of the magnetic body.

In a fourth aspect, a method of manufacturing a magnet comprises providing a magnetic body containing grains of a rare earth alloy; depositing a bead of terbium metal onto a surface of the magnetic body to form a magnet; and heat-treating the magnet.

BRIEF DESCRIPTION OF THE DRAWINGS

In order that the present invention may be more readily understood, an embodiment of the invention will now be described, by way of example, with reference to the accompanying drawings, in which.

DETAILED DESCRIPTION OF THE INVENTION

Figure 1:
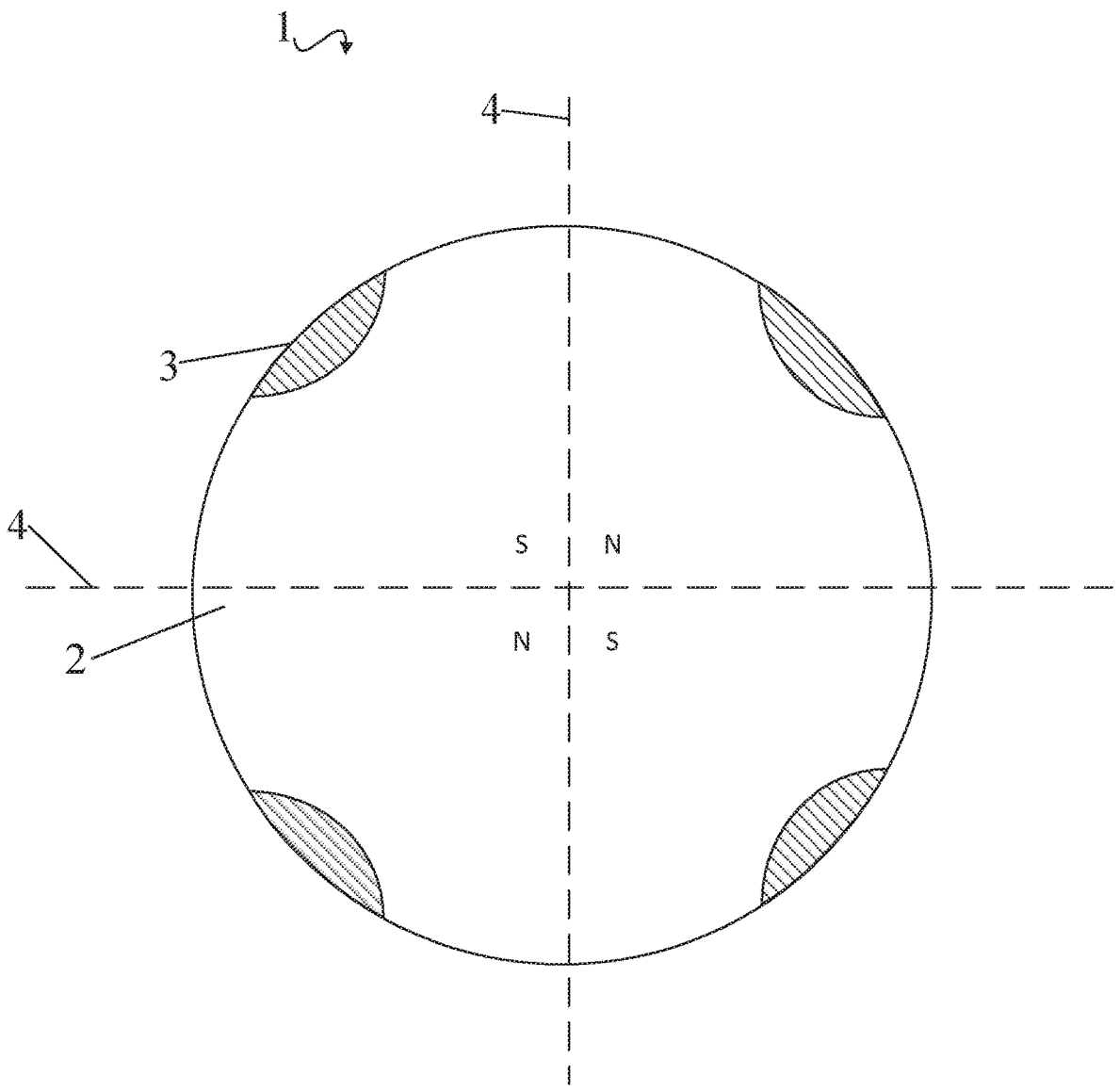
FIG. 1 shows a top view of a magnet according to an embodiment of the present invention.
Figure 2:
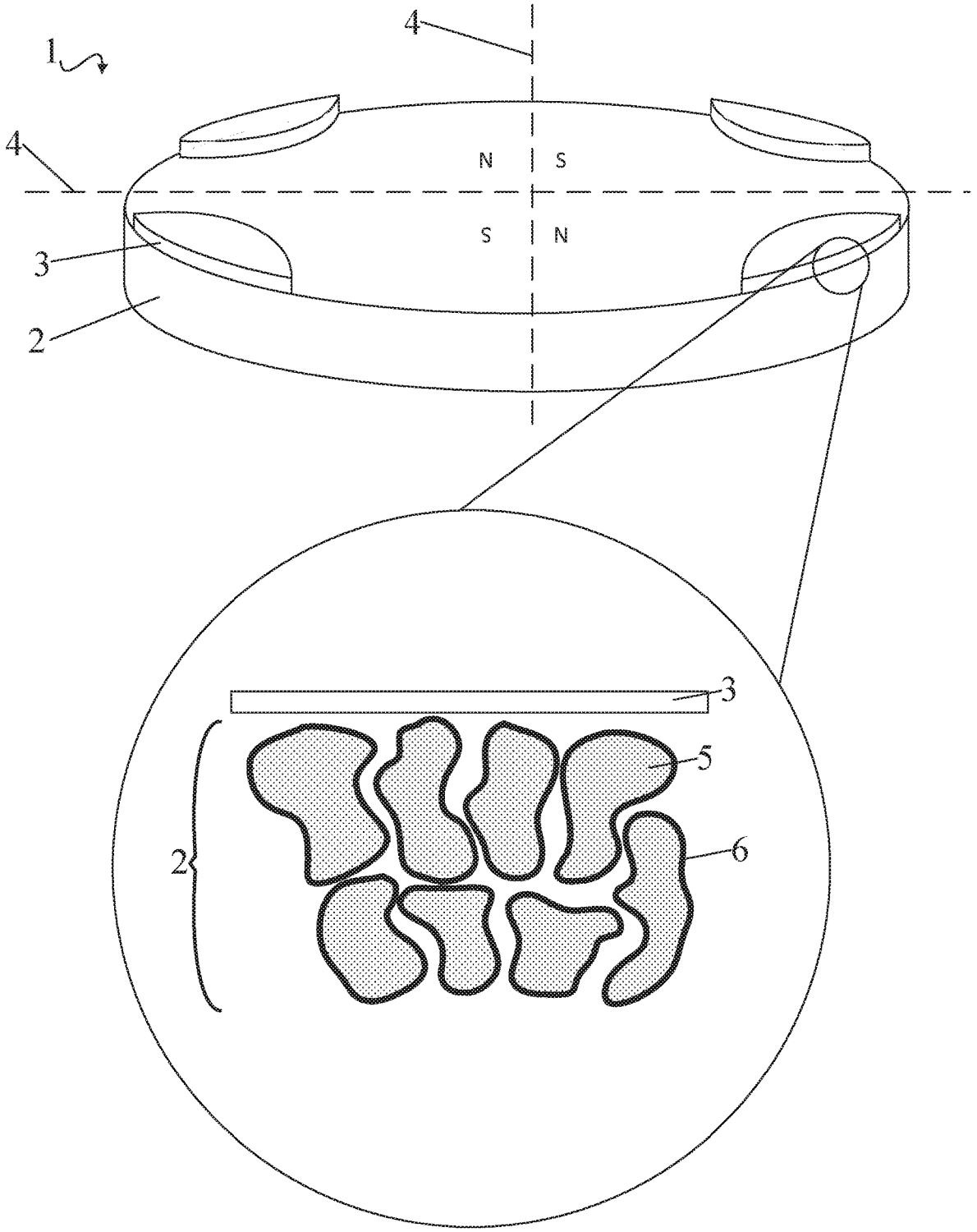
FIG. 2 shows a perspective view of the magnet and a cross-sectional view of a covered area of the magnetic body.
Figure 3:
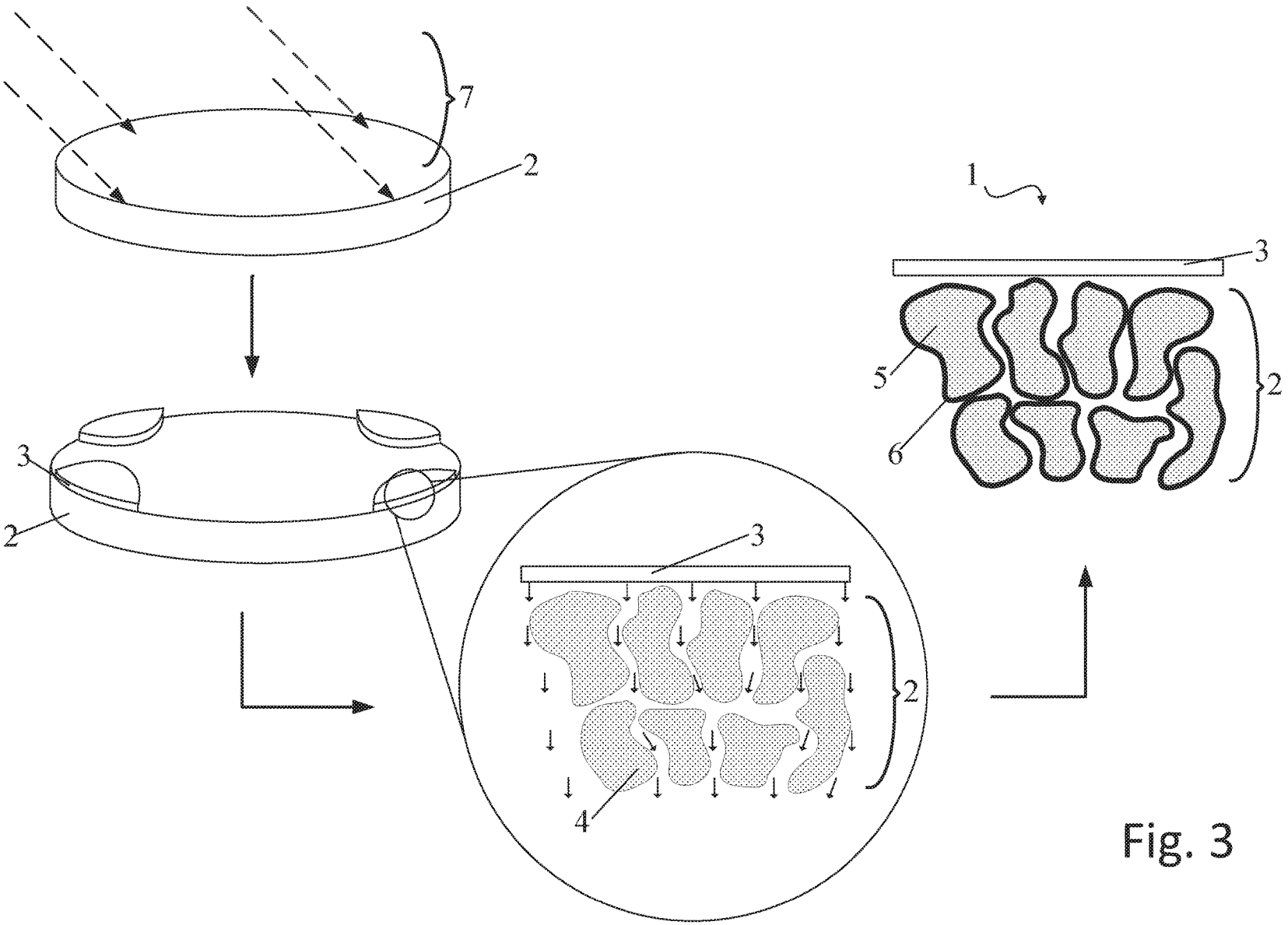
FIG. 3 is a flowchart showing the manufacturing process of the magnet.

The magnet 1 of FIGS. 1, 2, and 3 comprises a cylindrically shaped magnetic body 2 and beads of dysprosium metal 3 deposited on a surface of the magnetic body 2. The magnet 1 is shown as having four poles, which are shown as being geometrically divided by pole intersections 4. Each pole of the magnet 1 has a region of high magnetic field density which is positioned in-between the pole intersection 4.

The magnetic body 2 comprises sintered grains 6 of a rare earth alloy. The grains 5 are shown as discrete granules with a boundary. Specifically, the bulk substance within the grains 5 comprises a $Nd_2Fe_{14}B$ alloy. The grains 5 adjacent the deposited bead each have a shell layer 7 around their boundary. The shell layer 6 comprises diffused dysprosium which has substituted into the crystal lattice structure of the rare earth alloy. Although dysprosium can diffuse into the bulk of the crystal structure within the grains 5, careful control of the heat treatment conditions allow for diffusion to occur more readily at the grain boundaries. Specifically the shell layer 6 comprises a $Dy_2Fe_{14}B$ or $(Dy,Nd)_2Fe_{14}B$ alloy where the dysprosium has substituted into the neodymium alloy. The shell layer 6 of dysprosium containing alloy formed around each grain 5 has an approximate thickness of 0.5 μm.

Each bead of dysprosium metal 3 is applied directly onto the magnetic body 2 using cold spray techniques. The bead 3 is shown to be uniform in topology and positioned on the edge of the magnet in a region that bisects each of the respective pole intersections. However, any part of the surface of the magnetic body 2 may have a bead of dysprosium deposited onto it, and the bead 3 can be applied in a uniform or non-uniform manner The deposition thickness of the bead is shown schematically in the figures. A minimum thickness is desired to promote diffusion of dysprosium within or around the grains 5. However, a diminishing return of improved coercivity and magnetic properties is observed past a layer thickness of 5 μm.

A method of manufacturing the magnet 1 will now be described with reference to FIG. 2. A magnetic body 2 containing grains of a $Nd_2Fe_{14}B$ alloy 5 is provided. A part of a surface of the magnetic body 2 is chosen to be coated in dysprosium. Dysprosium metal particles 7 are targeted, discharged and deposited onto the chosen part of the surface. The conditions used for cold spray of other metal powders, such as copper and iron can be applied to the cold spraying of dysprosium metal particles. The deposited dysprosium metal rapidly forms a layer 3 on the targeted surface of the magnetic body 2.

Following the deposition of dysprosium beads, the magnet 1 is heat treated. During the heat treatment, the shell layer forms around the grains of the magnetic body 2. The heat treatment comprises a grain boundary diffusion process, such that the heat treatment causes dysprosium in the coating beads 3 to diffuse along the boundaries of grains 5 in the magnetic body 2 to form a shell layer 6 containing a dysprosium containing alloy. The heat treatment follows the general method of heating the coated magnet 1 at a constant rate to an elevated first temperature and holding the magnet 1 at that elevated temperature for a time period of at least 6 hours. The first elevated temperature should be close to 1000° C., ideally 900° C. This temperature is hot enough to initiate and propagate the diffusion of dysprosium whilst avoiding sintering or melting of the magnetic grains 4.

The magnet 1 is then cooled at a controlled rate to a second elevated temperature which is lower than the first. The magnet 1 is held at this second elevated temperature for less time, around 30 minutes, before it is quenched to room temperature using a controlled cooling rate. The quenched magnet 1 exhibits improved magnetic properties around the regions of dysprosium bead deposition. For example, an increased coercivity at the regions of the magnet that have a high field density is observed.

In this illustrative embodiment, the magnet 1 is a four pole magnet, however, a magnet with any number of poles is envisaged to benefit from the deposition of dysprosium.

The bead of dysprosium 3 is demonstrated as being deposited using cold spray, although other target specific deposition techniques can equally be used to achieve a dysprosium bead deposition. Cold spray has been chosen as an illustrative example due to the accurate targeting and rapid time of deposition.

The grains 5 comprise $Nd_2Fe_{14}B$ alloys. The grains can also comprise other magnetic rare earth alloys, such as those containing samarium, praseodymium or cerium, particularly $SmCo_5$ and $Sm(Co, Fe, Cu, Zr)_7$. The diffusion of the dysprosium bead 3 along the boundaries of the alloy grains 6 readily occurs for at least these rare earth alloys.

The grains 5 can be wholly coated in the shell layer 6, as shown in the figures. Alternatively, agglomerated grains 5 can be coated with a shell layer 6, such that the shell layer 6 only covers the exposed boundaries of the grains 5.

Further research has shown that rare earth magnetic metal terbium can also be used in a cold spray deposition process to create a rare earth magnet with improved coercivity.

The invention claimed is:

1. A method of manufacturing a magnet, the method comprising:

providing a magnetic body containing grains of a rare earth alloy, wherein a surface of the magnet body is geometrically divided by pole intersections;

depositing a bead of dysporium metal onto a region farthest away from the pole intersections of the magnetic body via a cold spray process to form a magnet; and heat-treating the magnet.

2. The method of claim 1, wherein the magnetic body comprises a plurality of poles, and depositing a bead of dysprosium metal comprises depositing a bead of dysprosium metal onto a part only of a surface of each of the poles.

3. The method of claim 1, wherein each metal bead is deposited at the edge of the magnet body surface.

4. The method of claim 1, wherein heat-treating the magnet comprises a grain boundary diffusion process.

5. The method of claim 1, wherein heat-treating the magnet comprises:

heating the magnet to a first elevated temperature;

cooling the magnet to second temperature; and quenching the magnet to room temperature.

6. The method of claim 5, wherein the first elevated temperature is at least 900° C.

7. The method of claim 5, wherein the second temperature is at least 500° C.

8. The method of claim 5, wherein the composite magnet is held at the first elevated temperature for at least 6 hours.

9. The method of claim 5, wherein the composite magnet is held at the second temperature for at least 0.5 hours.

10. The method of claim 1, wherein the rare earth alloy is a neodymium alloy.

11. The method of claim 10, wherein the neodymium alloy is $Nd_2Fe_{14}B$.

12. A magnet comprising a magnetic body and one or more beads of dysprosium metal; wherein the magnetic body has a surface that is geometrically divided by pole intersection and contains grains of rate earth magnet alloy, and wherein each bead is deposited onto a region farthest away from the pole intersections via a cold spray process.

13. The magnet of claim 12; wherein each metal bead is deposited at the edge of the magnet body surface.

14. The magnet of claim 12; wherein the magnet is cylindrical in shape.

15. The magnet of claim 12, wherein the magnetic body is a sintered rare earth magnet.

16. The magnet of claim 12, wherein the rare earth alloy is a neodymium alloy.

17. The magnet of claim 16, wherein the neodymium alloy is $Nd_2Fe_{14}B$.

18. The magnet of claim 12, wherein an amount of dysprosium is diffused within the grains.

19. The magnet of claim 18, wherein the grains contain an amount of diffused dysprosium of between 0.5 to 15 percent by weight.

20. The magnet of claim 18, wherein the dysprosium is diffused along the boundaries of the grains to form a shell layer.

21. The magnet of claim 20, wherein the magnetic body comprises grains of $Nd_2Fe_{14}B$ with a shell layer comprising $Dy_2Fe_{14}B$ or $(Dy,Nd)_2Fe_{14}B$.

22. The magnet of claim 20, wherein the shell layer has a thickness of about 0.5 μm.

23. The magnet of claim 12, wherein the deposition thickness of the bead of dysprosium metal is between 1 to 5 μm.

* * * * *